US009982448B2

(12) United States Patent
Fricano

(10) Patent No.: US 9,982,448 B2
(45) Date of Patent: May 29, 2018

(54) ARTICULATED PLOW

(71) Applicant: Phillip James Fricano, Scottsdale, AZ (US)

(72) Inventor: Phillip James Fricano, Scottsdale, AZ (US)

( * ) Notice: Subject to any disclaimer, the term of this patent is extended or adjusted under 35 U.S.C. 154(b) by 0 days. days.

(21) Appl. No.: 15/018,261

(22) Filed: Feb. 8, 2016

(65) Prior Publication Data

US 2017/0226762 A1 Aug. 10, 2017

(51) Int. Cl.
*E04H 4/00* (2006.01)
*A63G 31/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC .. E04H 4/0006; A63B 69/0093; A63G 31/007
See application file for complete search history.

(56) References Cited

U.S. PATENT DOCUMENTS 586,983 A 7/1897 Wharton, Jr.
1,871,215 A 8/1932 Keller et al.
3,005,207 A 10/1961 Matrai
3,473,334 A 10/1969 Dexter
3,477,233 A 11/1969 Andersen
3,557,559 A 1/1971 Barr
3,562,823 A 2/1971 Koster
3,789,612 A 2/1974 Richard et al.
3,802,697 A 4/1974 Le Mehaute
3,913,332 A 10/1975 Forsman
4,522,535 A 6/1985 Bastenhof
4,792,260 A 12/1988 Sauerbier
5,766,082 A 6/1998 Lochtefeld et al.
7,476,986 B1 * 1/2009 Del Principe ..... F03B 13/185 290/42
8,262,316 B2 9/2012 Slater et al.
9,175,488 B2 11/2015 Fricano
2008/0286048 A1 * 11/2008 Carnahan ..... A63B 69/0093 405/79
2010/0060008 A1 * 3/2010 Hostetler ..... F03B 17/067 290/54

FOREIGN PATENT DOCUMENTS

WO WO 2004085841 A1 * 10/2004 ..... F03B 17/067

* cited by examiner

*Primary Examiner* — Tara Mayo-Pinnock
(74) *Attorney, Agent, or Firm* — Dorsey & Whitney LLP

(57) ABSTRACT

Disclosed embodiments include an articulated plow that displaces water within a pool to create water wave energy. The articulated plow may include blades that are vertically engaged and coplanar during a wave energy stroke, thereby forcing water in front of the plow to be displaced. During the wave energy stroke, the static water plane behind the plow may be maintained at a predetermined elevation. During a reset stroke, the blades may rotate through their respective centroidal axis simultaneously to a horizontal attitude, thereby gliding through the static water.

22 Claims, 12 Drawing Sheets

ARTICULATED PLOW

FIELD

Disclosed embodiments relate to a water-wave-energy-generating apparatus. More specifically, disclosed embodiments relate to a water-wave-energy-generating apparatus utilizing a reciprocating articulated plow.

BACKGROUND

The art has recognized the desirability of providing a wave-energy-generating apparatus for use in pools and inland lakes. These devices have ranged from merely rolling a log down an incline into an end of a pool for generating wave energy along the length thereof to sophisticated arrangements of timed and phased-related plural propagation devices for use along extensive sections of a beach. Others have attempted to provide useful apparatuses for generating wave energy using a series of valves for the rapid release of volumes of water into a pool to provide energy. Others have used rapid release of air under pressure from underwater, thereby forcibly displacing a volume of water. Some have used non-reciprocating motions and instead use, for example, movement along a circular, closed, continuous path. A linear wave-energy apparatus category may include a motor boat in open waters towing a plow device or a mechanically driven plow in a circuit or linear displacement along a track or cable system to create wave energy.

Simple, non-articulated, reciprocating plows are utilized in wave testing laboratories. However, there are drawbacks to utilizing this simple plow concept. When the simple plow travels in a wave generating stroke, the static water level behind the plow drops proportionately with the plow displacement. Subsequent to the completion of the wave generating stroke, a considerable dwell time must be provided to allow reversal wave energy to decay. In full-scale or natural similitude, this reversal wave energy creates an undesirable under tow and possibly a rip tide, which is dangerous to swimmers and surfers. Further, during the reset stroke, a trough can occur directly along the front, downflow face of the non-articulated plow if the rate of return on the reset stroke is too fast, causing turbulence in front of the plow which propagates down flow away from the wave generating plow.

Prior devices may create waves, but such devices lack efficiency, reliability, safety, and desired results. Specifically, prior devices have not overcome problems in energy release; problems in the control of energy rate, level, and frequency; and problems relating to the formation of undesirable rip tides, turbulence, cavitation, and whirlpools. Some prior devices do not generate wave conditions desirable for surfing. Some devices provide for a continuous board-surfing ride, but fail to create a natural ocean-like surfing experience. Some devices may not provide adequate time for the surfer to enter the water as is necessary for the surfer to establish readiness for riding the wave. In the event of a surfer losing control, some continuous wave pool systems can create a dangerous scenario much like a high-speed automobile race track where one car losing control can create a multiple-car collision. Some devices do not generate a true barrel wave because the depth of water from the surface to the upper face of the wave-forming generator is extremely shallow. Some devices merely provide a moving thin hollow of water stream that carries a board surfer, creating a condition that causes the board surfer to ride atop the surface of the stream and limited to lateral motion, basically remaining stationary in lieu of maintaining position on the face of the water wave within the wave vortex or riding on the wave crest.

Certain methods and systems for making waves have been the subject of patents. U.S. Pat. No. 586,983 by William Wharton, Jr., dated Jul. 27, 1897, describes the generation of waves with a plow, whereby one or more vertically stacked blades are each articulated to pivot at an axis of rotation nearest the top of each blade. U.S. Pat. No. 1,871,215 by Charles W. Keller and Albert F. Siferte, dated Aug. 9, 1932, describes water wave energy generated by releasing a log from a predetermined height along an inclined ramp. U.S. Pat. No. 3,005,207 by Miklos Matrai, dated Oct. 24, 1961, describes waves generated by an oscillating paddle. U.S. Pat. No. 3,473,334 by Phillip Dexter, dated Oct. 21, 1969, describes creating a wave using water stored in a reservoir to produce a predetermined head and subsequently releasing the water from beneath the surface of a body of water in a surfing area. U.S. Pat. No. 3,477,233 by P. F. Andersen, dated Nov. 11, 1969, describes creating waves using an elongated buoyant member rotated about an axis parallel to its elongated direction by a driving means separate from the member. U.S. Pat. No. 3,557,559 by Douglas W. Barr, dated Jan. 26, 1971, describes creating a wave using a surge generating device communicating with two vertical and initially parallel walls, one of which curves outwardly from the other wall, which remains straight. U.S. Pat. No. 3,562,823 by Friedrich Koster, dated Feb. 16, 1971, describes a swimming pool equipped with a submerged oscillating blade that pivots back and forth to generate waves. U.S. Pat. No. 3,789,612 by George E. Richard and Eugene D. Richard, dated Feb. 5, 1974, describes a wave generator that includes a buoyant plunger mounted for vertical reciprocation within a chamber having a shoreward-facing opening. U.S. Pat. No. 3,802,697 by Bernard J. Le Mehaute, dated Apr. 9, 1974, describes a wave-forming body positioned in a channel so that water is deflected by the upper surface of the body as long as movement exists relative to the water. U.S. Pat. No. 3,913,332 by Arnold H. Forsman, dated Oct. 21, 1975, describes a plurality of generators providing serial waves on opposite sides of a tunnel structure having screen grills to prevent surfers from colliding with the wave generators. U.S. Pat. No. 4,522,535 by Dirk Bastenhof, dated Jun. 11, 1985, describes generating surf waves using a charge of high pressure air vented into an upper portion of a caisson, forcing the water from the caisson into a pool in a single forceful motion. U.S. Pat. No. 4,792,260 by Charles E. Sauerbier, dated Dec. 20, 1988, describes generating waves using a generator hull that is partially submerged in the water, and a means for propelling the hull through the water in a direction of motion. U.S. Pat. No. 5,766,082 by Thomas J. Lochtefeld and Jeffery W. Henry, dated Jun. 16, 1998, describes a water ride having a channel of water connected to a beach area and releasing a torrential flow of water into a channel to create a swell that travels through the channel, thereby creating a solitary tidal wave that spills and breaks onto a beach. U.S. Pat. No. 8,262,316 by Kelly Slater and Adam Fincham, dated Sep. 11, 2012, describes a wave generator and a wave pool that generates surface gravity waves using foils vertically arranged along a side wall, and moved against the water in the channel to generate a wave in water moving past a leading surface.

SUMMARY

In some embodiments, a water wave energy generation system may include an articulated plow and a water replenishment pipe configured to maintain a static water plane within a volume of water behind the articulated plow during a water wave energy stroke. The articulated plow may include an upper blade movable within an upper blade range including an upper blade vertical attitude and an upper blade horizontal attitude, a lower blade movable within a lower blade range including a lower blade vertical attitude and a lower blade horizontal attitude, and a mechanism configured to move the articulated plow in a down-flow displacement direction in a water wave energy stroke and move the articulated plow in an up-flow displacement direction in a reset stroke.

In some embodiments, an articulated plow for water wave energy generation may include an upper blade movable within an upper blade range including an upper blade vertical attitude and an upper blade horizontal attitude; a lower blade movable within a lower blade range including a lower blade vertical attitude and a lower blade horizontal attitude; a stanchion; an upper control arm linking the stanchion to the upper blade; and a lower control arm linking the stanchion to the lower blade. The articulated plow may be configured to be moved in a down-flow displacement direction in a water wave energy stroke and moved in an up-flow displacement direction in a reset stroke.

In some embodiments, a method of generating water wave energy may include moving an articulated plow in a down flow displacement direction during a water wave energy stroke, the articulated plow having blades in a vertical position; supplying water to an up flow side of the articulated plow; moving the articulated plow in an up flow displacement direction during a reset stroke; and moving the blades from a vertical position to a horizontal position during the reset stroke.

DETAILED DESCRIPTION

Figure 1:
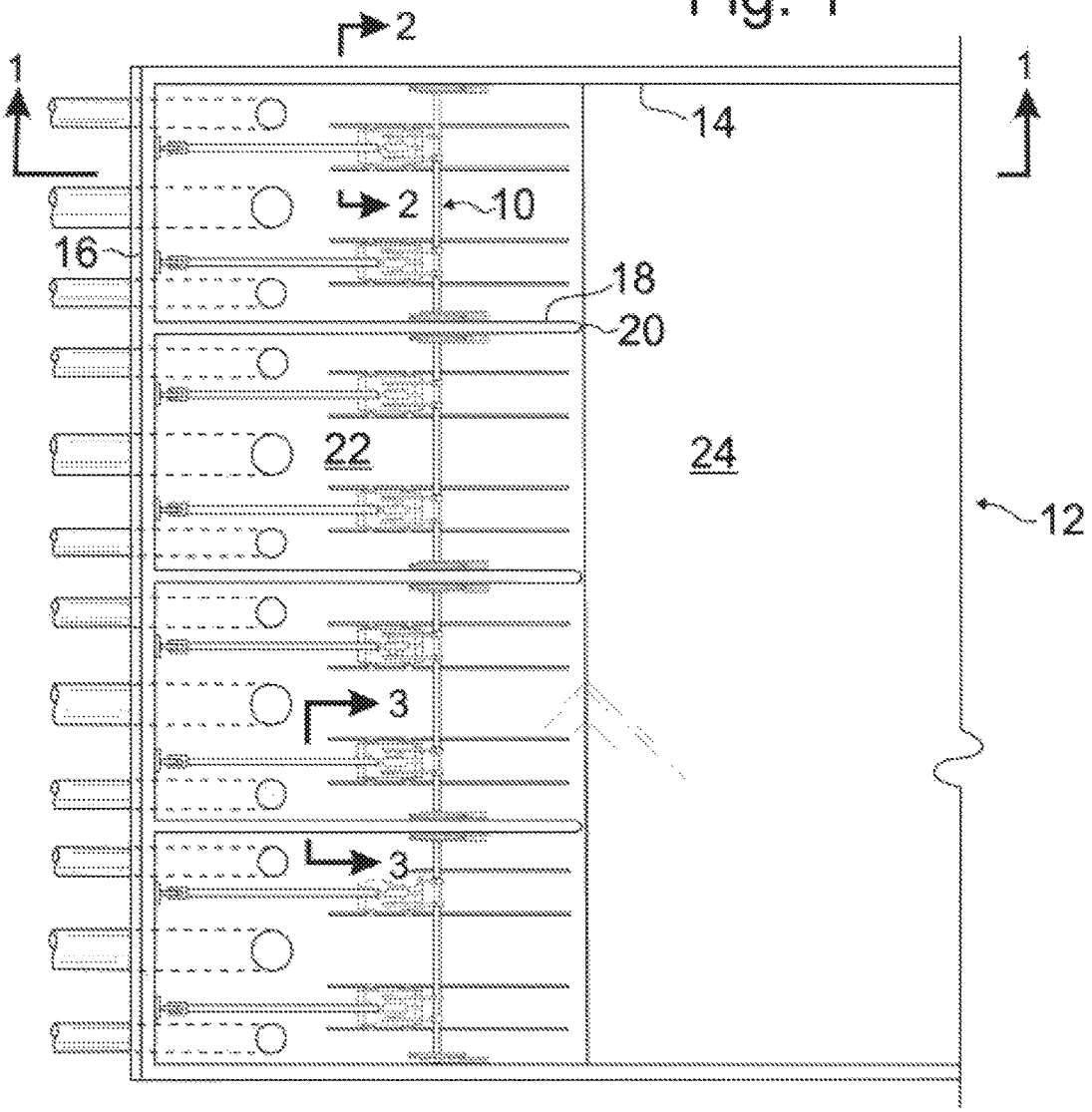
FIG. 1 shows a top view of a pool sectioned laterally showing a plurality of articulated plows operably positioned on a horizontal-floor area at an up-flow end of the pool, according to some embodiments.

Disclosed embodiments may include an articulated plow that travels in a linear reciprocating stroke within a wave energy end of a pool for creating water wave energy. When the articulated plow travels in a water wave energy stroke, an upper blade and a lower blade of the plow are engaged in a coplanar vertical position, thereby displacing a predetermined volume of water on the down flow side of the plow, creating wave energy.

When the articulated plow travels in the wave energy stroke, the upper blade and lower blade may be in a vertically engaged attitude and act as a single blade device. When the articulated plow completes the forward wave energy stroke and begins the reset stroke, the upper and lower blades disengage from a vertical attitude and move to a disengaged horizontal attitude. In this manner, the upper and lower blades may travel through the water with low resistance to the fluid dynamics imposed and without creating turbulence. Further, the amount of energy required in retraction is greatly reduced and the time required between successive wave energy is also greatly reduced making for more efficient water wave energy generation. In an embodiment, the vertical and horizontal attitude of the articulated plow may be mechanically controlled using a hydraulic piston without the need for secondary power source. In an embodiment, the blades may rotate through their respective centroidal axis, which may balance the mass of each blade, thereby allowing the blades to rotate with a minimum amount of work.

The displacement of the articulated plow during the wave energy stroke may progressively increase the area behind the plow, resulting in a drop in the static water plane. This drop may be undesirable and may be prevented by introducing a water volume through a replenishment pipe, thereby maintaining the static water plane. As such, the force required in the wave energy stroke is lessened and turbulence during a reset stroke is reduced. Maintaining the static water plane up-flow also improves the efficiency of the articulated plow by reducing dwell time between wave cycles, also referred to as the wave frequency.

In an embodiment, the pool in which the articulated plow is used may be defined in part by a horizontal floor converging with an inclined floor converging with an optional reef and eventual optional beach. The pool perimeter may be defined by a thrust wall positioned at the up-flow lateral end of the pool communicating in symmetry with a perpendicular side wall at each end of the thrust wall extending longitudinally down-flow to an open end with an optional beach. The horizontal floor communicating with the thrust wall, side wall, and up-flow face of the plow at a maximum displacement of a plow may define the general area occupied by a plurality of articulated plows. In an embodiment, there may be a plurality of articulated plow, each positioned in lateral alignment and separated by an intermediate wall connected to the thrust wall and terminating at the convergence of the horizontal floor with the inclined floor. The intermediate wall may allow each of the plurality of the articulated plow to advance in the wave energy stroke simultaneously or with a predetermined sequence so as to affect the wave energy as a whole. The face of the terminal end of the intermediate wall may have a prolate shape to eliminate turbulence at the confluence of water wave energy between and beyond the terminus of the intermediate wall. The side wall and intermediate wall may also structurally support the upper blade and the lower blade at both ends of each blade of the articulated plow. Embodiments may provide one or more of the articulated plow, depending on the height and lateral length of wave desired, and the pool width and length dimensions.

In an embodiment, a piston may push the articulated plow in a down-flow displacement direction in a water wave energy stroke and may pull the plow in an up-flow displacement direction in a reset stroke in preparation for subsequent water wave energy to be generated. The piston may be pivotally fastened at its proximal end to the thrust wall and the distal telescopic shaft end slidably fastened through a collar which may be structurally supported on both longitudinal sides by a purlin fastened to a lagging of a trolley. The distal end of the telescopic shaft may be fitted with or attached to a stanchion thereby providing adequate surface for the pivotal attachment of an upper right control arm, an upper left control arm, a lower right control arm and a lower left control arm. The control arms may enable displacement of a piston to control the articulation of the blades. The opposite end of each upper control arm may be pivotally attached onto a normal recess of the portion of a piston notch of the upper blade. Likewise, the opposite end of each lower control arm may be pivotally attached onto a normal recess of the portion of the piston notch of the lower blade. One or more trolleys may be intermediately positioned from each end of the articulated plow, traveling along a train-like rail thereby providing structural support of the mass of the articulated plow throughout the plow displacement.

The plow may be articulated with an upper blade and a lower blade, each of which simultaneously pivot about their respective centroidal axis of rotation in contrary rotational motion. When the articulated plow is normally positioned in a full-retracted mode of a piston telescopic shaft, ready for water wave energy generation, the upper blade and the lower blade may be engaged in a coplanar vertical attitude. When the piston telescopic shaft extends outwardly from the thrust wall in the wave stroke, in the down-flow direction, the articulated plow may advance in the wave stroke until a desired displacement is achieved and a wave energy is introduced to the static water plane in front and down-flow of the plow.

The displacement of the articulated plow and the rate of displacement of the articulated plow may determine the wave characteristics of amplitude, frequency, period, and wavelength. Subsequent to the articulated plow achieving the desired displacement (thereby establishing the pre-determined water wave energy), the plow becomes stationary for a specific dwell time so as to establish wave frequency.

During the dwell time, the established water wave energy continues to travel down-flow along the inclined floor where it may soon encounter interference with the inclined floor of the pool or optional reef. As the bottom-most wave energy encounters the interference with the progressing wave energy, it begins to drag, falling behind the forward progression, creating a wave crest. The wave crest mass is eventually overcome by gravity and begins to collapse and peel, creating a vortex between a face of the wave and the linear peel. Subsequent to achieving the desired wave-breaking characteristics, as the water wave energy travels down-flow along the inclined pool begins to decay, the water energy approaches an interface where the pool floor incline converges with the static water plane. Along the lateral length of the interface may be a trough to capture a run-up volume of water which may be equivalent to the water displaced as a result of the articulated plow displacement during the wave energy stroke. The trough may be covered with a grating to allow pool occupants to walk across the trough. The volume of run-up water captured within the trough may be returned to a water storage reservoir or tank until a predetermined volume of water is used to replenish and maintain the static water plane behind the articulated plow as the plow advances in the water wave energy stroke.

The articulated plow may then be ready to begin the reset stroke. At the onset of the reset stroke, the piston telescopic shaft may retract, pulling on the control arm linkage attached to the upper blade and the control arm linkage attached to the lower blade, forcing the upper blade and lower blade to simultaneously rotate about their respective centroidal axis in contrary motion to the horizontal disengaged attitude. The horizontal attitude of the upper blade and lower blade may allow the articulated plow to travel in the reset stroke with a negligible turbulence or unwanted secondary waves or rip tides.

One or both ends of the upper blade of the articulated plow may be fitted with a pinion gear mechanically engaged along the upper edge of a rack. Likewise, one or both ends of the lower blade of the plow may be fitted with a pinion gear mechanically engaged along the lower edge of the rack. The upper gear at each end of the upper blade may be used to rotate the upper blade to a vertical attitude to engage and horizontal attitude to disengage the upper blade for the reciprocation of the articulated plow. Similarly, the lower gear may be used to rotate the lower blade to a vertical attitude to engage and horizontal attitude to disengage the lower blade for the reciprocation of the articulated plow. Vertical and horizontal attitudes are directional with respect to the pool bottom, where a vertical attitude is generally perpendicular to the pool bottom, and the horizontal attitude is generally parallel to the pool bottom. The vertical attitude is any attitude that has a vertical component, and the horizontal attitude is any attitude that has a horizontal component, where the vertical attitude has a greater vertical attitude component than the horizontal attitude does. In other words, vertical is not necessarily entirely vertical, and horizontal is not necessarily entirely horizontal, so long as the vertical is more vertically aligned than is the horizontal. The rack may equally engage with the upper gear and the lower gear, whereby the rack maintains constant simultaneous rotational alignment of the upper gear and lower gear thereby providing rotational alignment of the upper blade and lower blade of the articulated plow throughout the reciprocating cycle. The rack may support the mass of the articulated plow. The rack may be transported by a series of wheels that travel along an upper rail and a lower rail attached to a structural channel positioned within a recess of, for example, a side wall and an intermediate wall. The lower wheel supports the rack and thereby supports the articulated plow. The upper wheel may maintain the linear trajectory of the rack and the articulated plow thereby preventing the plow from lifting upwardly during the wave energy stroke and the reset stroke when subjected to a vertical component vector force by the resistance of the mass of the water during displacement of the plow. There may be a plurality of lower wheels fastened to opposite ends of a rack thereto a lower rail to transmit the load of the rack, subsequent articulated plow and allow the plow and rack system to glide along said rail. The recess may also provide structural support of the rack, which transmits the weight of the articulated plow at both ends.

As the articulated plow progresses in the reset stroke, the plow may approach a shock absorber aligned to arrest the motion of the rack. Upon contact of the rack with the shock absorber, the piston telescopic shaft may continue to retract. The rack being restrained, the upper pinion gear and the lower pinion gear are forced to rotate simultaneously in opposing direction, thereby causing the upper blade and lower blade to rotate to the vertical engaged attitude until the piston retraction is stopped by engagement of an upper blade stop with a lower blade stop in conjunction with engagement of a limit switch (not shown). In this manner, the attitude of an upper blade and a lower blade may be changed without the need of an independent power source for controlling the attitude of the blades. The articulated plow may then be ready to generate subsequent water wave energy.

Disclosed embodiments may be used to generate water wave energy in a pool to provide specific predetermined wave characteristics down-flow of the device. Embodiments may be configured to provide a linear reciprocating stroke with a variable displacement for controlling wave energy amplitude and wave energy frequency. Wave energy wavelength may be controlled by displacing a predetermined volume of water.

A water replenishment pipe may be used to supply and maintain a static water plane within the volume of water behind the articulated plow during the water wave energy stroke. This may maintain equilibrium of the hydrostatic force against the up-flow face and down-flow face of the articulated plow, thereby greatly reducing the force required to advance the plow in the wave energy stroke. This may also allow the reset stroke of the articulated plow to travel through the water without creating undesirable turbulence which may adversely affect the ability to control the dwell time or frequency of wave energy generated.

FIG. 1 shows a top view of a pool 12 sectioned laterally showing a plurality of articulated plows 10 operably positioned on a horizontal-floor area 22 at the up-flow end of the pool 12, according to some embodiments. Each of the plurality of articulated plow 10 may be provided with substantially identical elements and capabilities so as to provide simplification in function and economies of scale in fabrication and assembly.

A side wall 14 at each opposite end of the pool 12 may be normal to a thrust wall 16 and encompass the horizontal floor 22 which communicates with an inclined floor 24 thereto communicating to an optional beach. Separating each of the plurality of the articulated plow 10 within the confines of the parallel side wall 14 is an intermediate wall 18 normal to and attached to the thrust wall 16. The intermediate wall 18 extend outwardly from the thrust wall 16 along the horizontal floor 22 to a predetermined distance in near proximity to the inclined floor 24. The distal end of an intermediate wall 18 is terminated with a prolate end 20 so as to prevent undesirable turbulence when volumes of water within the confines of the intermediate wall 18 and side wall 14, and the adjacent intermediate wall 18 converge beyond said walls.

Figure 2:
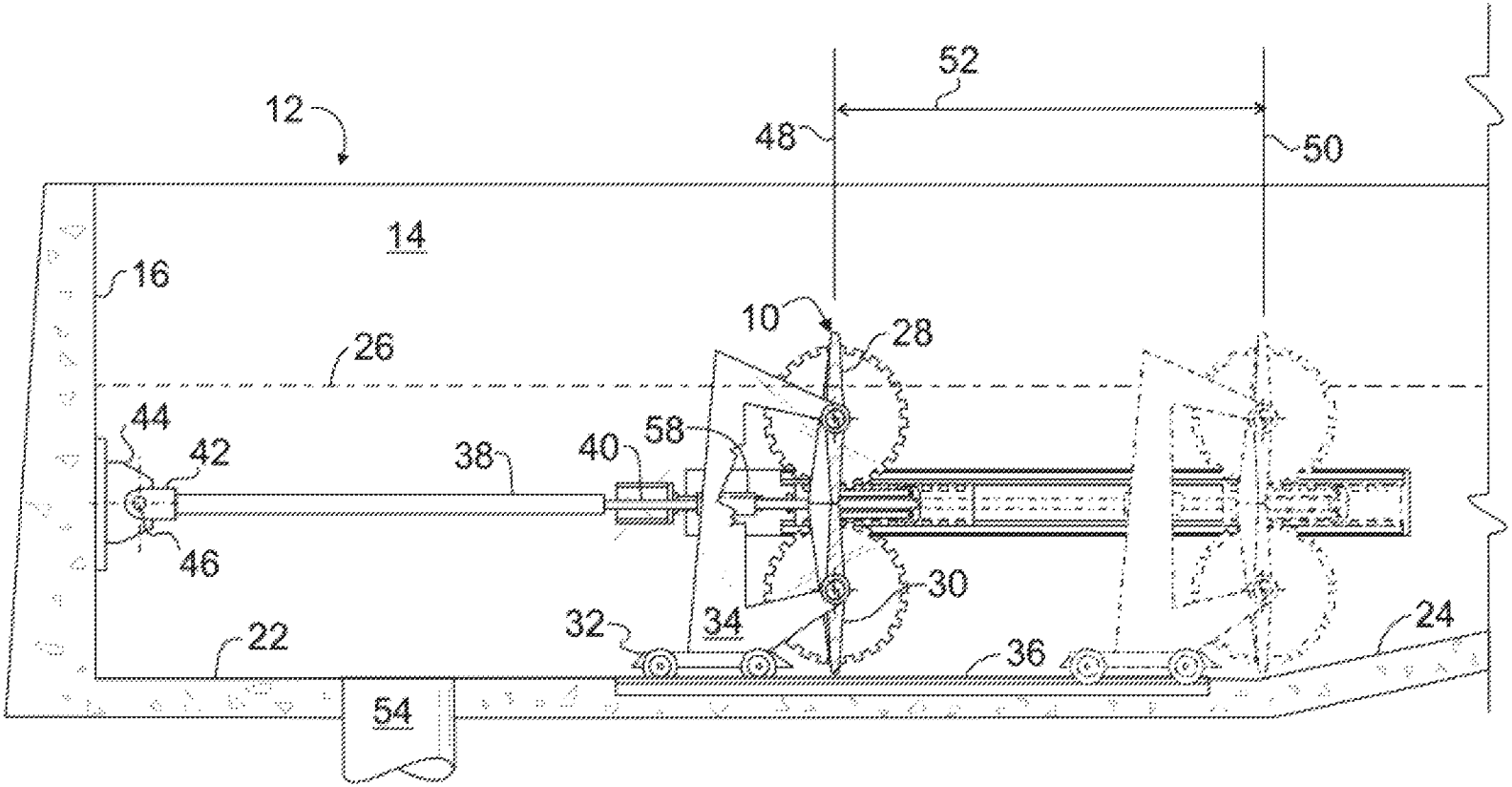
FIG. 2 shows a longitudinal side view of the pool of FIG. 1 taken from section 1-1 illustrating a maximum displacement of an articulated plow and a transition from a horizontal floor to an inclined floor.

FIG. 2 shows a longitudinal side view of the pool 12 of FIG. 1 taken from section 1-1, illustrating a maximum displacement 52 of the articulated plow 10 and a transition from the horizontal floor 22 to the inclined floor 24. A predetermined volume of water contained within the pool 12 is shown by a static water plane 26. The static water plane 26 extends from the thrust wall 16 to the inclined floor 24 at a lateral convergence line of equal elevation and extending the width of the pool 12 down flow towards an optional beach.

A grate-covered channel (not shown) of predetermined width may traverse between the convergence line and the optional beach. The channel is covered with the grating to bridge across the width of the channel thereby providing passage of swimmers and surfers walking between the pool 12 and the optional beach. The return channel collects water "run up" created beyond the static water plane 26 as a wave 128 decays. This "run up" volume of water may be collected, returned to a reservoir chamber (not shown), and pumped into the pool 12 through one or more of a water replenishment pipe 54 to maintain the static water plane 26 within the area confined between the side wall 14 and intermediate wall 18, the thrust wall 16 and the plow 10. This feature may contribute to the reduction of work required to generate the wave energy 134 stroke. Furthermore, the recycling method may provide for heating, filtering and purifying the pool 12 water during each cycle of wave energy 134 generation.

The articulated plow 10 includes an upper blade 28 and a lower blade 30, which are shown in a vertical coplanar attitude for generating the wave energy 134. The upper blade 28 and the lower blade 30 are structurally supported by a lagging 34 of a trolley 32 which travels a predetermined distance along the horizontal floor 22 on a pair of a trolley rail 36 extending between the thrust wall 16 and the juncture of the horizontal floor 22 and the inclined floor 24. The articulated plow 10 is displaced along the rail 36 on the trolley 32 by a hydraulic piston 38. The piston 38 is restrained at the proximal end at the thrust wall 16 and structurally attached to the thrust wall 16 by a dog 44 communicating with a clevis 42 which is pivotally connected to the dog 44 by a clevis pin 46. A telescopic shaft 40 of piston 38 is slidably attached through a collar 58 which is fastened onto a lagging 34 by a purlin 56 which is fastened onto the trolley 32 thereby providing structural support of the telescopic shaft 40 at the distal end of the piston 38. The collar 58 also maintains alignment of the telescopic shaft 40 and thusly the articulated plow 10 when subjected to dynamic hydrostatic forces before, during, and after the plow 10 reciprocating motion. When the telescopic shaft 40 of the hydraulic piston 38 is fully retracted, the articulated plow 10 is at a full retraction position 48. When the hydraulic piston 38 is fully extended, the articulated plow 10 is at a full extension position 50. As such, a maximum displacement 52 occurs. However, a predetermined displacement within the range from full retraction position 48 to the full extension position 50 is attainable. When the articulated plow 10 travels from the full retraction position 48 to an extension in a wave stroke 120 (see, e.g., FIG. 7), a wave 128 is generated as a result of the water wave energy 134 (see, e.g., FIG. 8).

Figure 3:
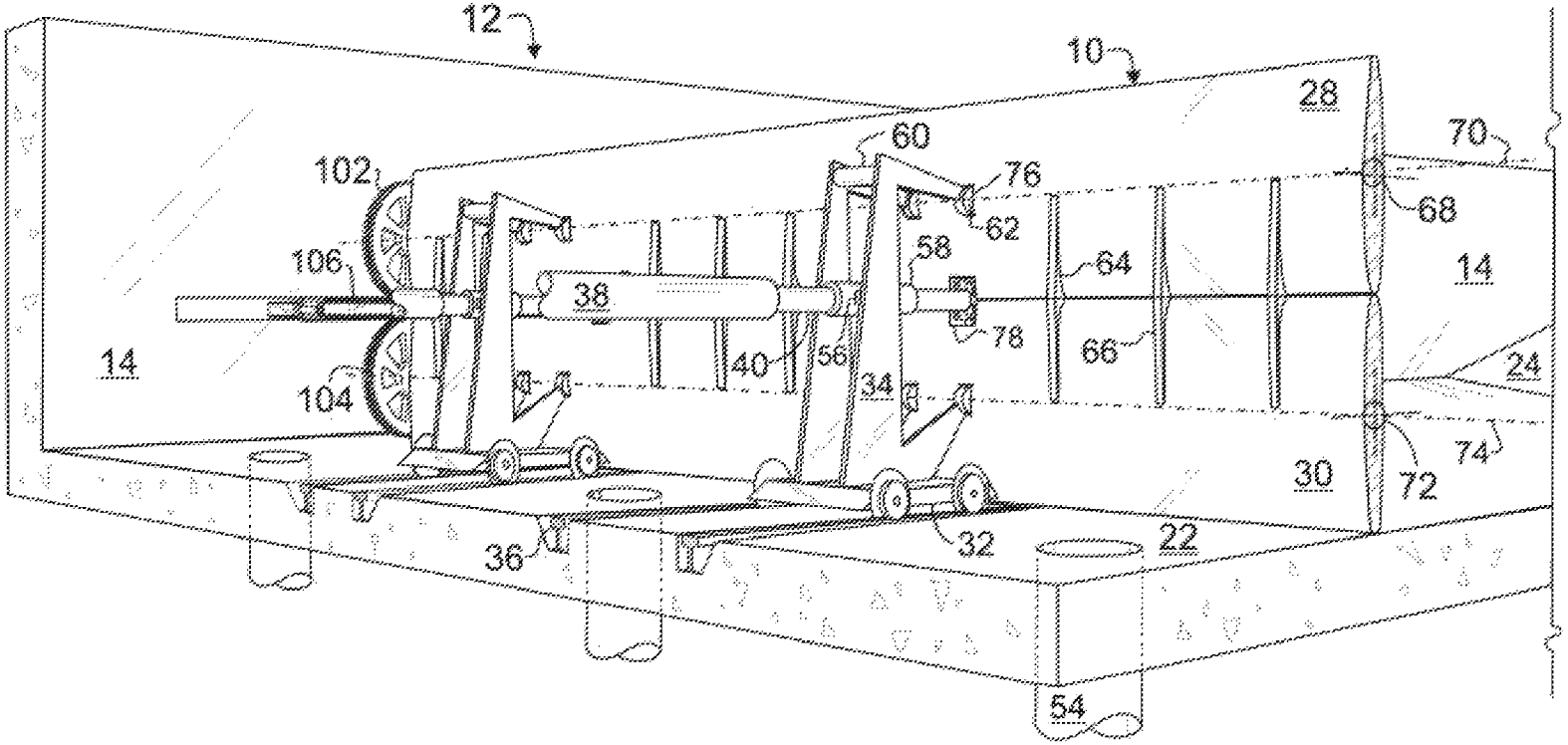
FIG. 3 shows a perspective view of an articulated plow with an upper blade and a lower blade engaged in the vertical attitude, according to some embodiments.

FIG. 3 shows a perspective view of an articulated plow 10 with the upper blade 28 and the lower blade 30 engaged in the vertical attitude, according to some embodiments. The upper blade 28 rotates through a centroidal upper blade axis of rotation 70. Likewise, the lower blade 30 rotates through a centroidal lower blade axis of rotation 74. This configuration provide for balance of both the upper blade 28 and the lower blade 30 regardless of rotational attitude. Alternatively, either or both blades may rotate about any suitable axis, including placed at one edge of the blade, at the opposite edge, or anywhere in between. The upper blade 28 and the lower blade 30 are structurally supported and pivot about an upper blade shaft 68 and lower blade shaft 72 respectively. The trolley 32 includes a lagging 34 fitted with a bushing 62 so as to provide the upper blade 28 and the lower blade 30 rotational motion with reduction in friction and wear of both the upper blade shaft 68 and the lower blade shaft 72 at the surface of the contact respectively. The lagging 34 with the bushing 62 is fitted onto the upper blade shaft 68 and lower blade shaft 72 passing through a lagging notch 76 so as to provide adequate clearance in the simultaneous rotational stroke of the upper blade 28 and rotational stroke of the lower blade 30.

Any suitable number of blades may be used. In one embodiment, two blades are used. In another embodiment, one blade is used, where that blade may have a width greater than, less than, or generally equal to the depth of the water. In other embodiments, multiple blades are used, organized in a vertically stacked or spaced array, with little, no, or any desired amount of space between them.

Figure 13:
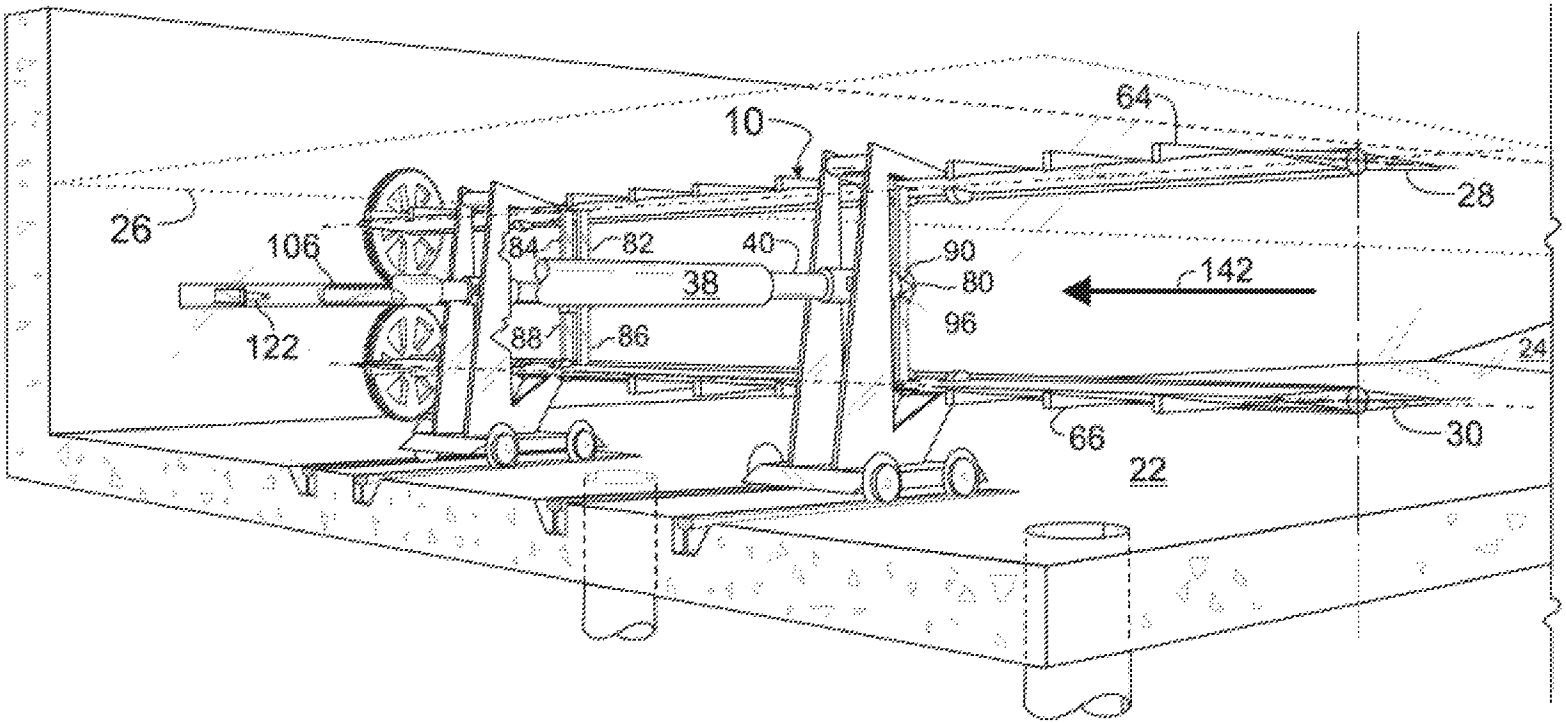
FIG. 13 shows a perspective view of an articulated plow showing an upper blade and a lower blade in a disengaged and horizontal attitude and a rack in proximity to and in alignment with a shock absorber as the plow continues in a reset stroke, according to some embodiments.

The proximal end of an upper right control arm 82 and the proximal end of an upper left control arm 84 are attached onto the upper portion of a stanchion 80 with a first pin 90 (see, e.g., FIG. 13). The proximal end of a lower right control arm 86 and the proximal end of a lower left control arm 88 are attached onto the lower portion of the stanchion 80 with a second pin 96. The distal end of the upper right control arm 82 is attached to the corresponding piston notch 78 at the upper blade 28 with a third pin 92 (see, e.g., FIG. 13). The distal end of the upper left control arm 84 is attached to the corresponding piston notch 78 of the upper blade 28 with a fourth pin 94. The distal end of the lower right control arm 86 is attached onto the corresponding piston notch 78 at the lower blade 30 with a fifth pin 98. The distal end of the lower left control arm 88 is attached onto the corresponding piston notch 78 at the lower blade 30 with a sixth pin 100 (shown in FIG. 13). The pins may act as pivot points.

Figure 4:
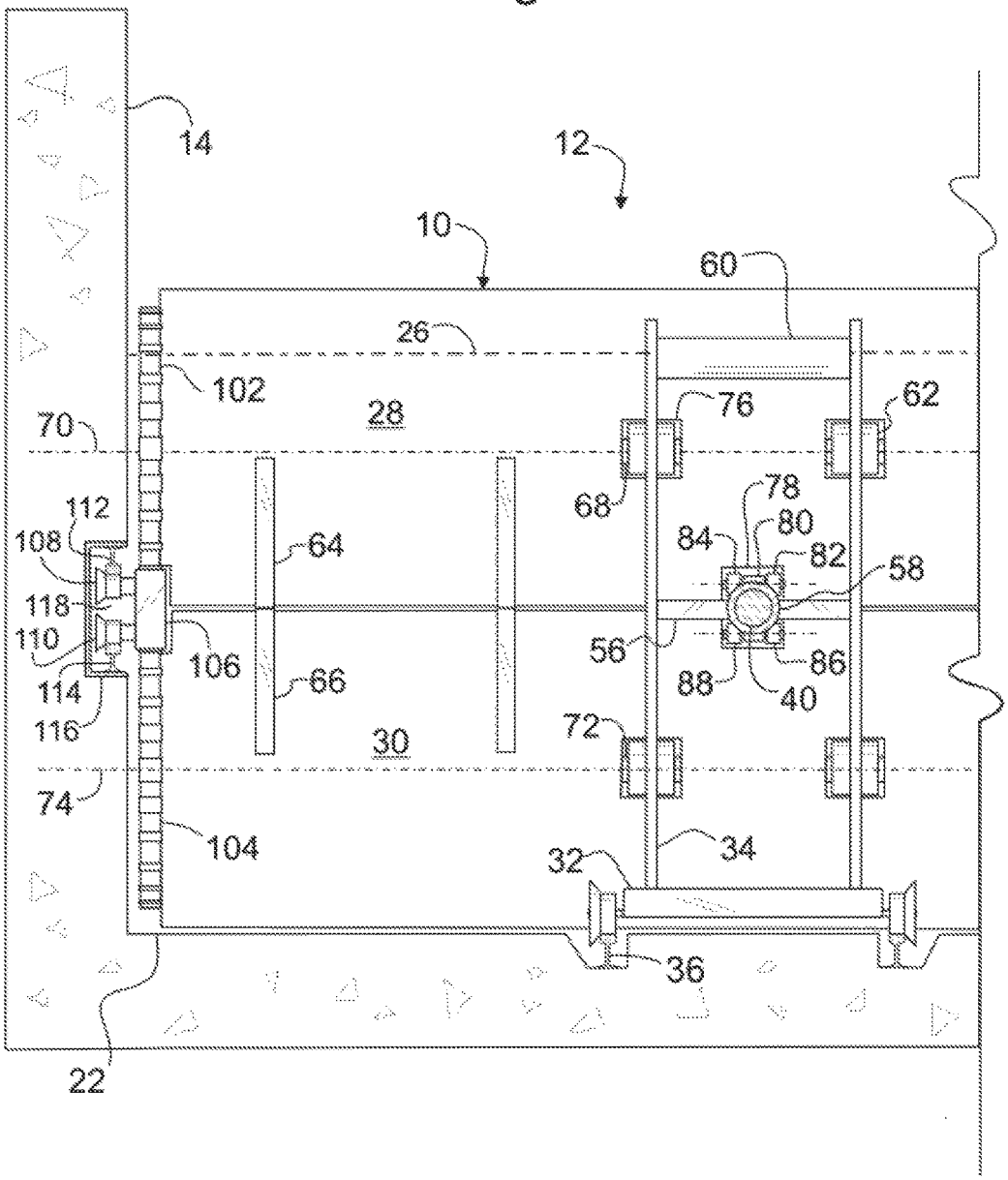
FIG. 4 shows a vertical section 2-2 taken from FIG. 1 showing an articulated plow communicating with and supported by a side wall.

FIG. 4 shows vertical section 2-2 taken from FIG. 1 showing the articulated plow 10 communicating with and supported by the side wall 14. In addition to the collar 58 supporting the plow 10, each end of the upper blade 28 includes an upper pinion gear 102 and each end of the lower blade 30 includes a lower pinion gear 104. Symmetrically and mechanically engaged between the upper pinion gear 102 teeth and the lower pinion gear 104 teeth is a cogged rack 106. The rack 106 includes a flanged upper wheel 108 and two or more of a flanged lower wheel 110 that communicates with an upper rail 112 and a lower rail 114 respectively. The upper rail 112 and the lower rail 114 are fastened to the upper flange and lower flange of a structural channel 116 respectively which is positioned within a recess 118 which provides for positioning the flanged upper wheel 108 and the flanged lower wheel 110 within the vertical plane of the intermediate wall 18 and side wall 14 thereby allowing the articulated plow 10 to be in close proximity to the side wall 14 and the intermediate wall 18 for the purpose of minimizing the seepage of water between the plow 10 and the side wall 14 and the intermediate wall 18 during the wave stroke 120 and structural support of the articulated plow 10. The flanged upper wheel 108 is positioned mid-length of the rack 106 and each of the two flanged lower wheel 110 is positioned in proximity toward each opposite end of the rack 106. This arrangement of the flanged lower wheels 110 provides support of the mass of the articulated plow 10 due to gravity, and the flanged upper wheel 108 prevents inadvertent upward force which could cause misalignment during the longitudinal displacement of the plow 10 during the wave stroke 120 and the reset stroke 142.

Figure 5:
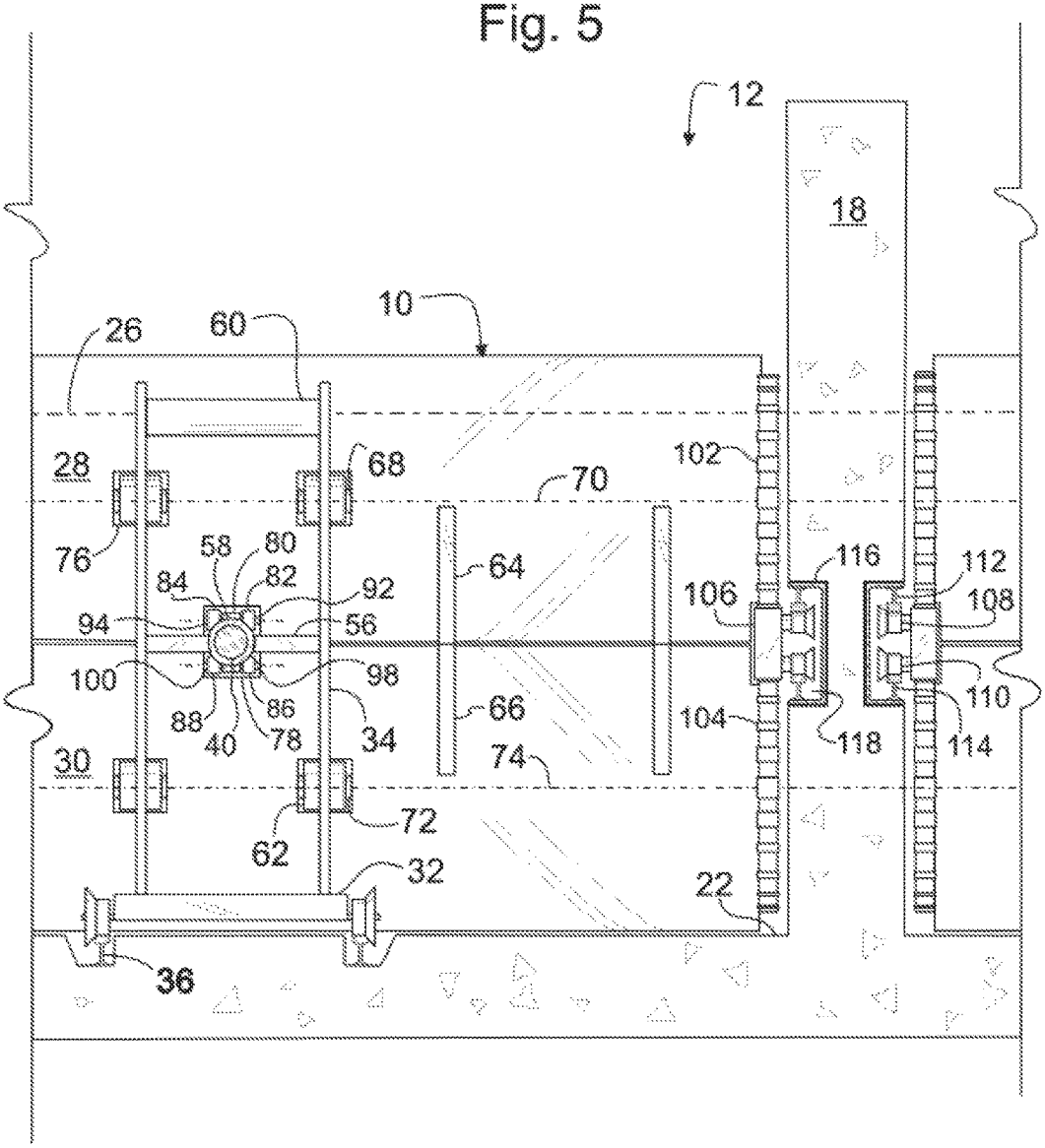
FIG. 5 shows a vertical lateral section 3-3 taken from FIG. 1 showing two articulated plows structurally supported and separated by an intermediate wall.

FIG. 5 shows a vertical lateral section 3-3 taken from FIG. 1 showing the articulated plow 10 structurally supported and separated by an intermediate wall 18. The width of the intermediate wall 18 may be at a predetermined minimum dimension so as to minimize potential turbulence between an adjacent pair of the plow 10 sharing the intermediate wall 18. Further reduction of turbulence between plow 10 sharing wall 18 may be established by providing a prolate end 20 along the vertical terminal face of the wall 18 as shown in FIG. 1.

Figure 6:
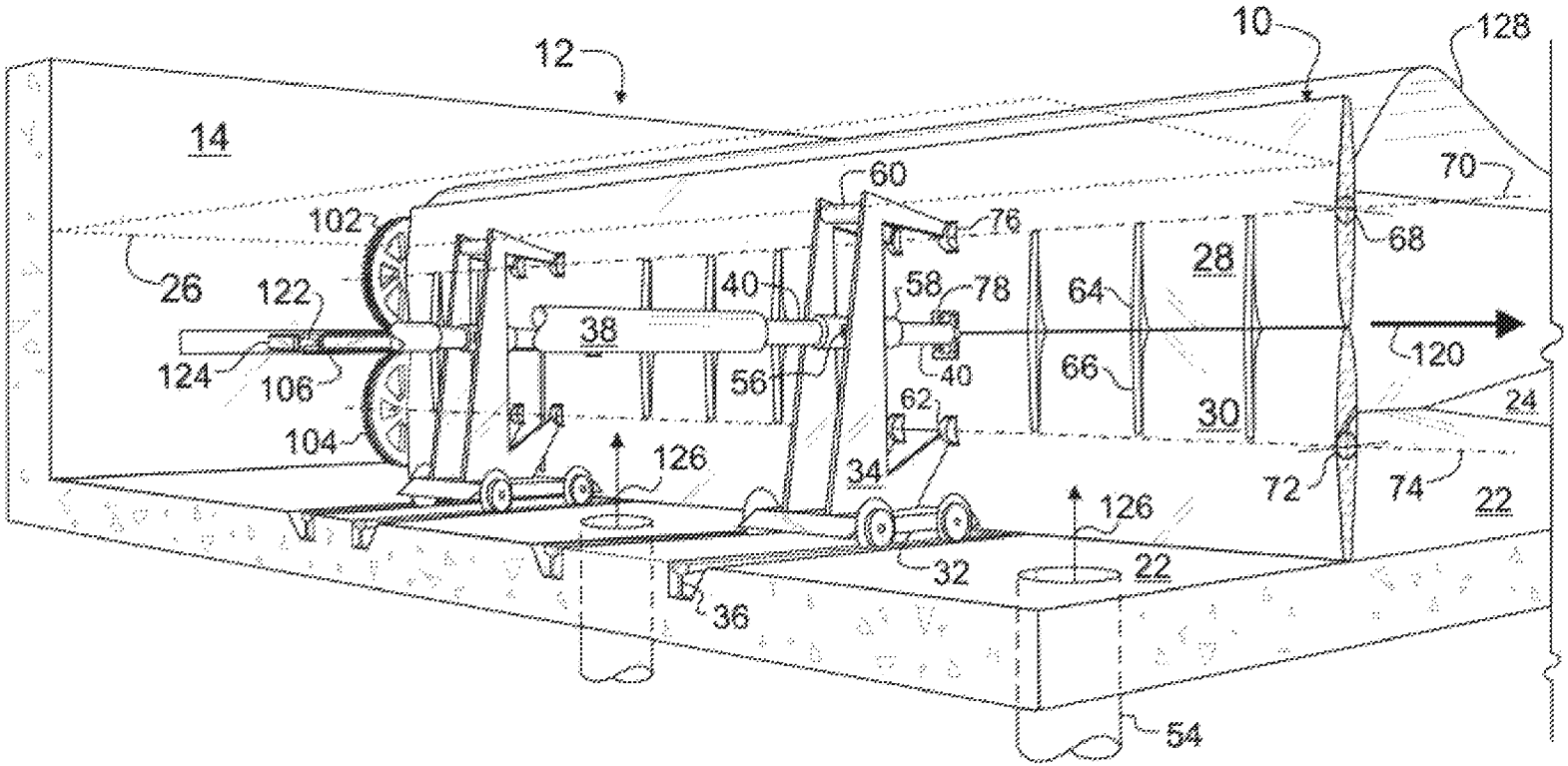
FIG. 6 shows a perspective view of an articulated plow moving in a wave stroke to generate a wave and also shows the relationship between the wave and a static water plane, according to some embodiments.

FIG. 6 shows a perspective view of an articulated plow 10 moving in the wave stroke 120 to generate a wave 128 and also shows the relationship between the wave 128 and a static water plane 26, according to some embodiments. At the onset of the wave stroke 120 displacement down-flow, the static water plane 26 contained between the thrust wall 16, the side wall 14 and/or intermediate wall 18 and the plow 10 would begin to drop because this initial volume of water virtually remains constant as the area increases. It is shown that the static water plane 26 is maintained substantially constant by the influence of water from a plurality of water replenishment pipes 54 positioned adjacent to and parallel to the thrust wall within the confines of the horizontal floor 22. As the articulated plow 10 advances through the wave stroke 120, a predetermined volume and rate of flow of water enters the pool 12 through the water replenishment pipe 54, maintaining the static water plane 26 on the up-flow side of the plow 10. Furthermore, maintaining the static water plane 26 within the confines of the thrust wall 16, the side wall 14 and/or intermediate wall 18, and the plow 10 substantially maintain in equilibrium the lateral hydraulic forces of the water pressure applied to both the up-flow and down-flow face of the plow 10. As such, this equilibrium reduces the work necessary to advance the plow 10 in the wave stroke 120. Therefore, the net work or force through displacement applied by the piston 38 through a predetermined displacement throughout wave stroke 120 may be essentially the resultant resistance of the displacement of the water volume on the down-flow face of the plow 10.

When the articulated plow 10 advances from the full retraction position 48 to a predetermined displacement in the wave energy stroke 120, the upper blade 28 and lower blade 30 are engaged vertically so as to provide a horizontal force in the displacement of a predetermined volume of water on the down-flow face of the plow 10 along a submerged area of the articulated plow 10. The force provided by piston 38 through the extension of the telescopic shaft 40 communicating with the stanchion 80 is transmitted through the upper right control arm 82 and upper left control arm 84 to the upper blade 28. Likewise, the force provided by piston 38 through the extension of the telescopic shaft 40 communicating with the stanchion 80 is transmitted through the lower right control arm 86, and lower left control arm 88 to the lower blade 30. When the articulated plow 10 advances in the wave stroke 120, the translation of force through the upper right control arm 82, upper left control arm 84, lower right control arm 86, and lower left control arm 88 is directed to the upper blade 28 and lower blade 30 respectively. The upper blade 28 and the lower blade 30 may be restrained from rotating beyond the vertical coplanar attitude by fitting the upper blade 28 and the lower blade 30 with one or more of a upper blade stop 64 paired with and in alignment with a lower blade stop 66 respectively.

Figure 7:
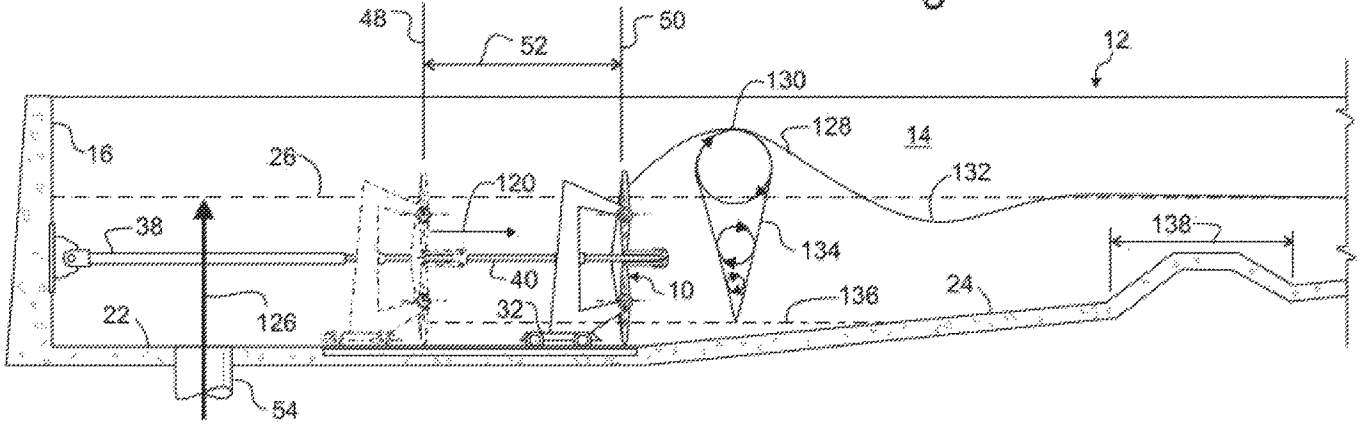
FIG. 7 shows a longitudinal cross section of a wave generating end of a pool, including a wave stroke with a corresponding volume of water replenishment through a water replenishment pipe, according to some embodiments.

FIG. 7 shows a longitudinal cross section of the wave generating end of the pool 12, including the wave stroke 120 with a corresponding volume of the water replenishment 126 through a water replenishment pipe 54, according to some embodiments. The upper pinion gear 102, the lower pinion gear 104, the rack 106, upper wheel 108, lower wheel 110, the upper rail 112, the lower rail 114, the structural channel 116, recess 118, a shock absorber 122, and a bracket 124 are omitted from FIG. 7 in order to provide clarity. These aforementioned elements are also excluded from FIGS. 9-11.

The travel of the plow 10 is shown at with the maximum displacement 52 at the full extension position 50 which would provide a condition to generate a maximum amplitude of the wave 128. When the articulated plow 10 reaches any predetermined displacement, the plow 10 stops moving in the wave stroke 120 for a predetermined dwell time.

The wave energy 134 is graphically demonstrated by a plurality of circles representing the molecular motion of the water molecules which rotate in the greatest diameter at the water's surface and diminish in rotational motion diameter to a mere point at a zero wave energy 136 depth. Beyond the depth of the zero wave energy 136 there is no energy. The water wave energy 134 is dependent on the velocity and displacement of the articulated plow 10 as it travels from the full retraction position 48 in the wave stroke 120 to a predetermined distance of displacement. As such, the predetermined velocity and the predetermined displacement establish the desired amplitude and wavelength of the wave 128, thereto creating a crest 130 and a trough 132.

Figure 8:
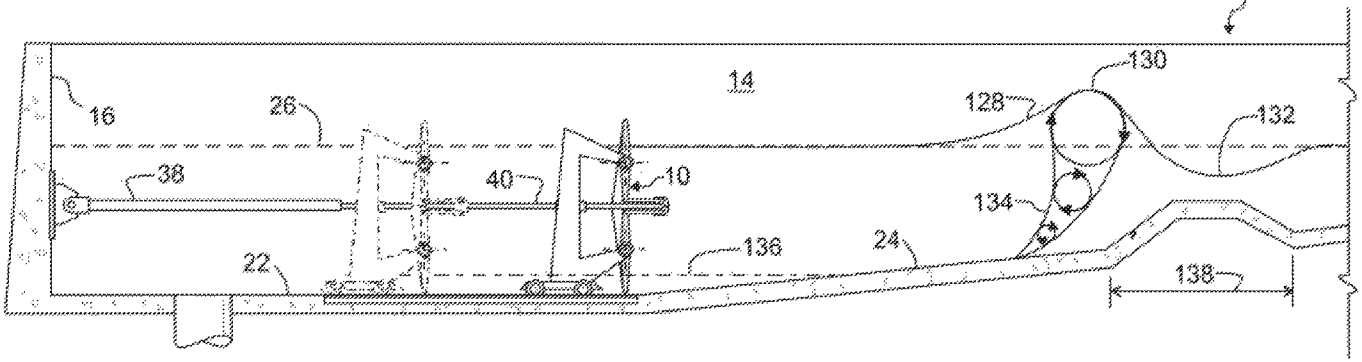
FIG. 8 shows a longitudinal cross section of a wave generating end of a pool, including an articulated plow coming to rest at a full extension position of a driving piston for a predetermined dwell time, upon achieving a maximum displacement, according to some embodiments.

FIG. 8 shows a longitudinal cross section of the wave 128 generating end of the pool 12 and the articulated plow 10 coming to rest at the full extension position 50 of a driving piston 38 for a predetermined dwell time, upon achieving the maximum displacement 52. When the plow 10 travels from the full retraction position 48 to a displacement less than the maximum displacement 52, the wave 128 generated by the wave energy 134 will have less amplitude and less wavelength. The wave 128 characteristics are also determined by the velocity of the articulated plow 10 during the wave stroke 120. As the wave 128 water wave energy 134 travels along the inclined floor 24, the bottom most depth of the water wave energy 134 comes in contact with the inclined floor 24. This contact causes the bottom-most point of the wave energy 134 to begin to lag behind the advancing position at the crest 130 of the wave 128. Therefore, the greatest lag of the wave 128 exists at the bottom-most point of the wave energy 134, diminishing to zero at the crest 130. The amount of wave 128 lag progressively increases as the wave energy 134 travels along the inclined floor 24 as it approaches an optional reef 138.

Figure 9:
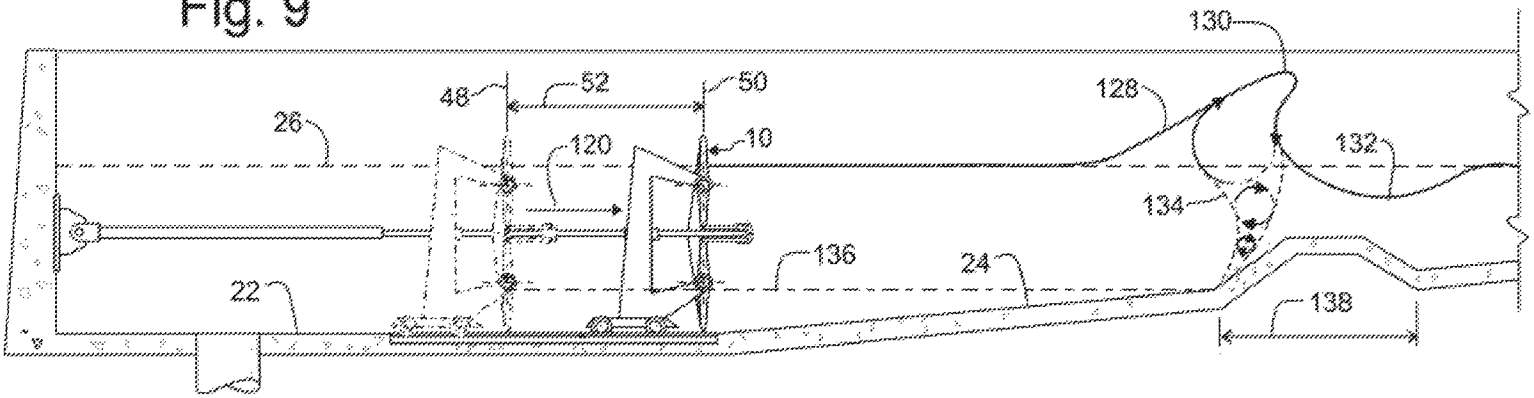
FIG. 9 shows a longitudinal cross section of a wave generating end of a pool showing an articulated plow at rest at a predetermined dwell time, according to some embodiments.

FIG. 9 shows a longitudinal cross section of the wave 128 generating end of the pool 12 showing the articulated plow 10 at rest at a predetermined dwell time, according to some embodiments. The water wave energy 134 becomes further distorted by an ever-increasing drag when the energy 134 encounters an optional reef 138. The reef may be a natural reef or an artificial reef, and may be as depicted in U.S. Pat. No. 9,175,488, which is incorporated herein by reference.

Figure 10:
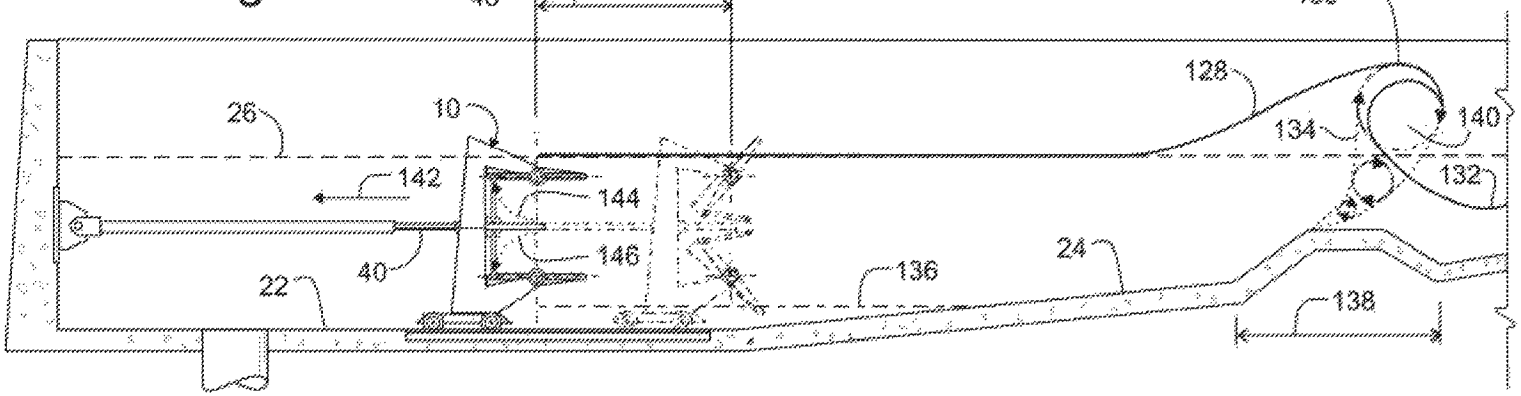
FIG. 10 shows a longitudinal cross section at a wave-generating end of a pool with an articulated plow commencing a reset stroke subsequent to a predetermined dwell time, according to some embodiments.

FIG. 10 shows a longitudinal cross section at a wave generating end of a pool 12 with an articulated plow 10 commencing a reset stroke 142 subsequent to the predetermined dwell time, according to some embodiments. At the onset of the reset stroke 142, the upper blade 28 and the lower blade 30 shift simultaneously to an upper blade rotation reset 144 attitude and lower blade rotation reset 146 attitude respectively, bringing the upper blade 28 and the lower blade 30 parallel and horizontal. This attitude allows the plow 10 to "cut" through the water without creating undesirable turbulence.

As the telescopic shaft 40 of the hydraulic piston 38 begins to retract, creating the reset stroke 142, the upper right control arm 82, the upper left control arm 84, the lower right control arm 86, and the lower left control arm 88 simultaneously force the upper blade 28 and the lower blade 30 to rotate to an upper blade rotation reset 144 attitude and a lower blade rotation reset 146 attitude respectively.

The mass of the wave 128 may begin to be overcome by the force of gravity causing the crest 130 to begin to collapse and peel, forming a vortex 140. Upon reaching the reef 138 the mass of water at the crest 130 may be overcome by the force of gravity and consequently begin to collapse causing the wave 128 to break and peel. This condition of the wave 128 establishes the vortex 140 with a maximum height at the crest 130 and the maximum depression of the trough 132. Such waves may be desirable for surfers and the board surfer has the opportunity to "ride the wave" inside the vortex as the wave "peels". This particular type of configuration defines the wave 128 to be classified as a breaking-barrel wave. In a scenario whereby the option to generate a non-breaking wave 128 is desired, the board surfer rides atop the crest 120 of the wave 128.

Figure 11:
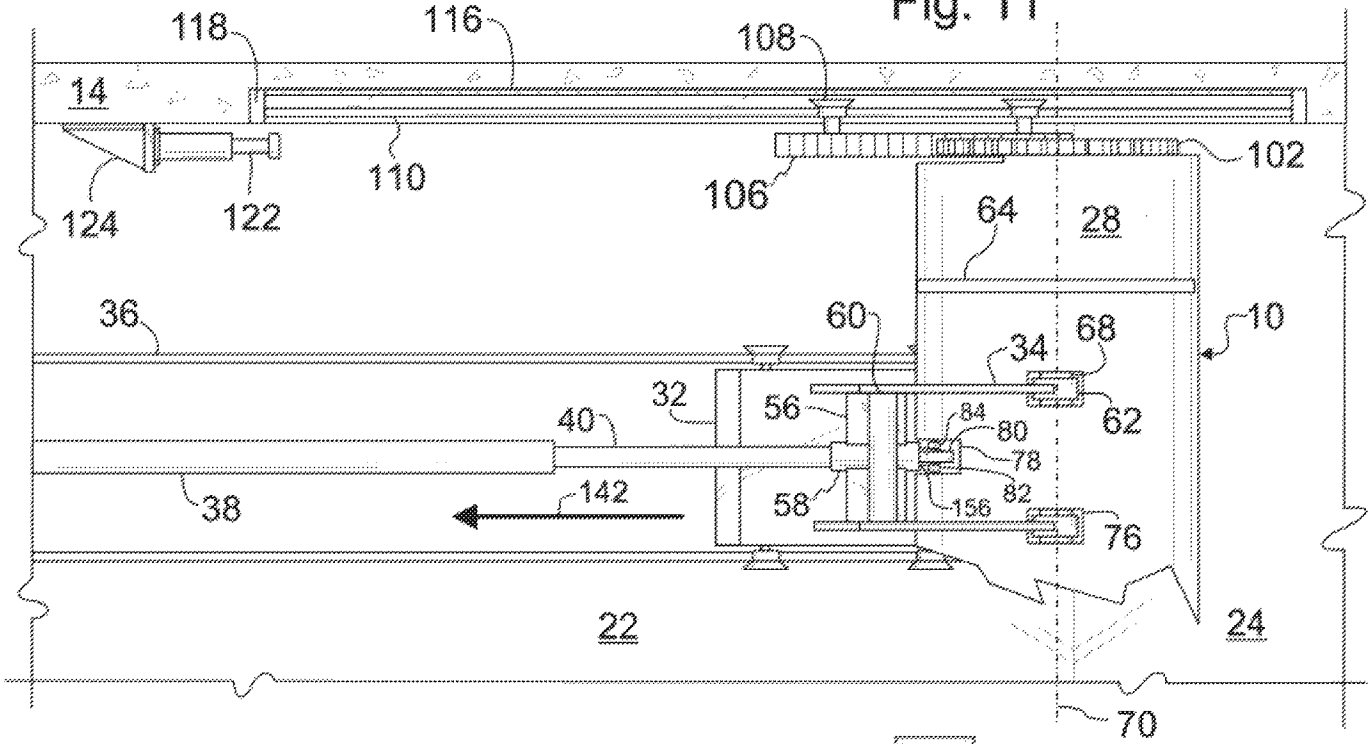
FIG. 11 shows a top view of an articulated plow in a reset stroke resulting from a simultaneous upper blade rotation reset with a lower blade rotation reset, according to some embodiments.

FIG. 11 shows a top view of the articulated plow 10 in the reset stroke 142 resulting from the simultaneous upper blade rotation reset 144 and the lower blade rotation reset 146, according to some embodiments. When the upper blade 28 and the lower blade 30 rotate to execute the reset stroke 142, the upper pinion gear 102 and the lower pinion gear 104 rotate respectively and correspondingly with the upper blade 28 and the lower blade 30. The rotation causes the rack 106, which is equally engaged with the upper pinion gear 102 and lower pinion gear 104 to travel in linear horizontal motion away from the upper blade axis of rotation 70 and the lower blade axis of rotation 74 and in the same direction as the reset stroke 142. When the upper blade 28 and lower blade 30 simultaneously rotate to the vertical engaged attitude they are forced to stop in rotation when the stanchion 80 comes in contact with the collar 58 at an interface 156 caused by the retraction of the telescopic shaft 40 of the piston 38.

Figure 12:
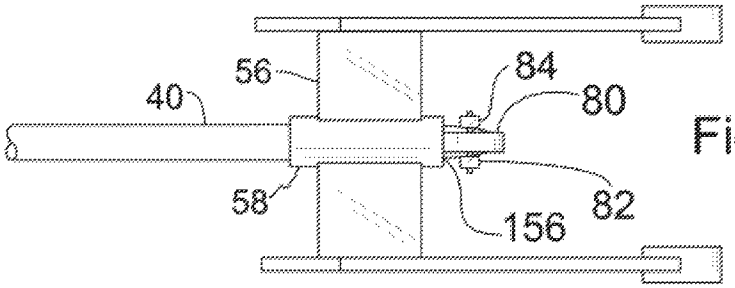
FIG. 12 shows an enlarged top view of selected elements of FIG. 11 showing a lagging, a telescopic shaft, a purlin, a collar, a stanchion, an upper right control arm, an upper left control arm, and an interface.

FIG. 12 shows an enlarged top view of selected elements of FIG. 11 showing the lagging 34, the telescopic shaft 40, the purlin 56, the collar 58, the stanchion 80, the upper right control arm 82, the upper left control arm 84, and the interface 156. FIG. 12 provides further clarity of the interface 156 shown in FIG. 11.

FIG. 13 shows a perspective view of the articulated plow 10 showing the upper blade 28 and the lower blade 30 in a disengaged and horizontal attitude, showing the rack 106 in proximity to and in alignment with the shock absorber 122 as the plow 10 continues in the reset stroke 142. The shock absorber 122 may be mounted to the thrust wall 16 via the bracket 124.

Figure 14:
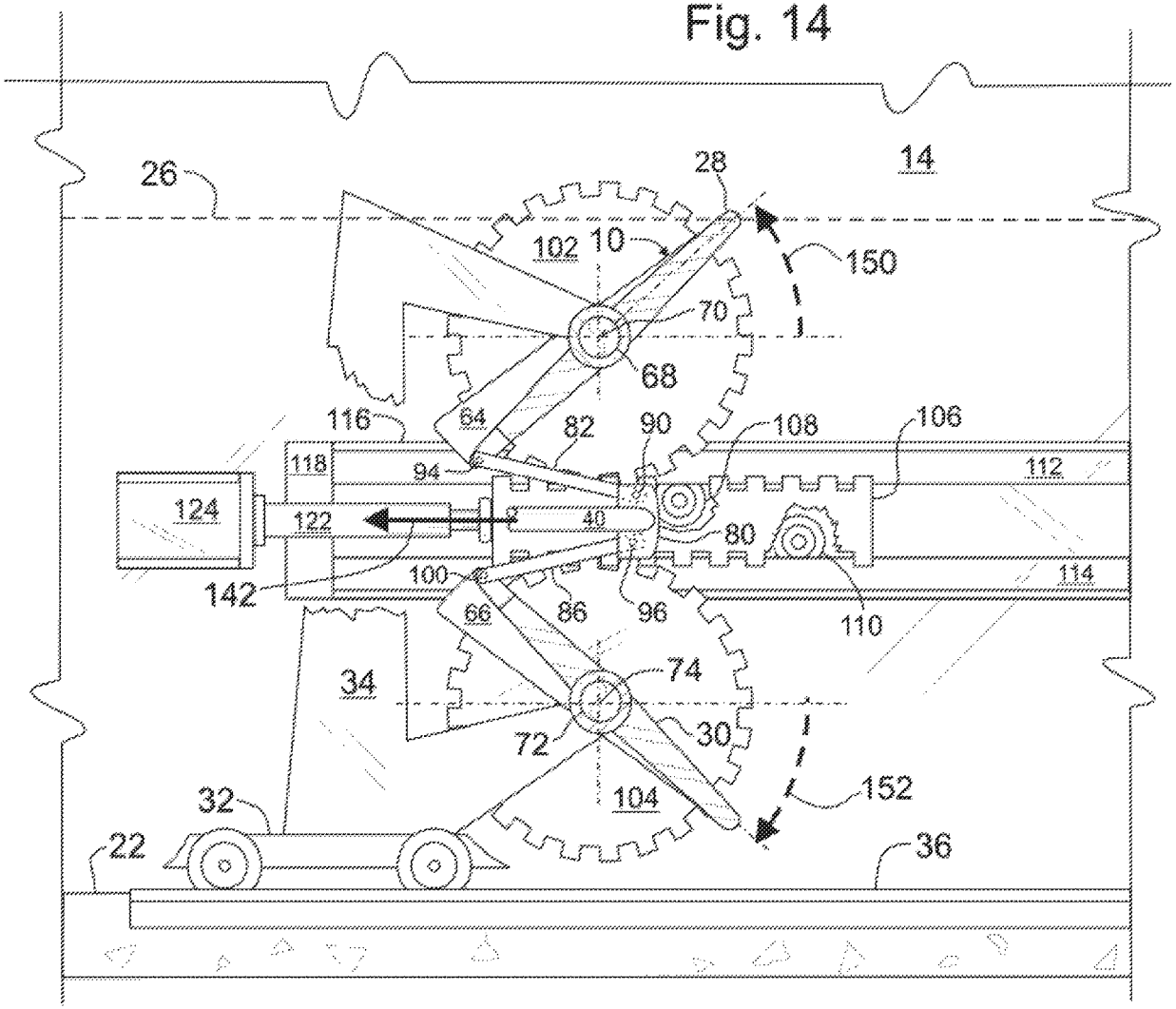
FIG. 14 shows a close-up longitudinal vertical section of an articulated plow showing an upper blade rotating about an upper blade axis of rotation in an upper blade rotation reset direction simultaneous with a lower blade rotating about a lower blade axis of rotation in a lower blade rotation reset direction as a result of a telescopic shaft continuing to retract, according to some embodiments.

FIG. 14 shows a close-up longitudinal vertical section of the articulated plow 10 showing the upper blade 28 rotating about the upper blade axis of rotation 70 in an upper blade rotation reset 150 direction simultaneously with the lower blade 30 rotating about the lower blade axis of rotation 74 in a lower blade rotation reset 152 direction as a result of the telescopic shaft 40 continuing to retract, according to some embodiments. In the process of the shaft 40 continuing to retract in the reset stroke 142, the rack 106 remains stationary as a result of contact with the shock absorber 122. As the shaft 40 continues to retract, the proximal end of the upper right control arm 82, and the proximal end of the upper left control arm 84 (first shown in FIG. 13) are forced to pivot about a first pin 90 fastened at the stanchion 80. Simultaneously the proximal end of the lower right control arm 86 and proximal end of the lower left control arm 88 (first shown in FIG. 13) are forced to pivot about a second pin 96 fastened at the stanchion 80. Simultaneously, the distal end of the upper right control arm 82 is forced to pivot about a third pin 92 (not shown) fastened at a piston notch 78 common to both the upper blade 28 and the lower blade 30. Simultaneously, the distal end of the upper left control arm 84 is forced to pivot about a fourth pin 94 fastened at the piston notch 78 common to both the upper blade 28 and the lower blade 30. Simultaneously, the distal end of the lower right control arm 86 is forced to pivot about a fifth pin 98 (not shown) fastened at the piston notch 78 common to both the upper blade 28, and the lower blade 30. Simultaneously, the distal end of the lower left control arm 88 is forced to pivot about a sixth pin 100 fastened at the piston notch 78 common to both the upper blade 28 and the lower blade 30. As such, the upper right control arm 82 and upper left control arm 84 force the upper blade 28 to rotate in an upper blade rotation reset 150 direction, and the lower right control arm 86 and lower left control arm 88 force the lower blade 30 to rotate in a lower blade rotation reset 152 direction simultaneously. In other embodiments, some or all of the above-described actions are not done simultaneously, and instead may be done in any desired sequence with any suitable spacing.

Figure 15:
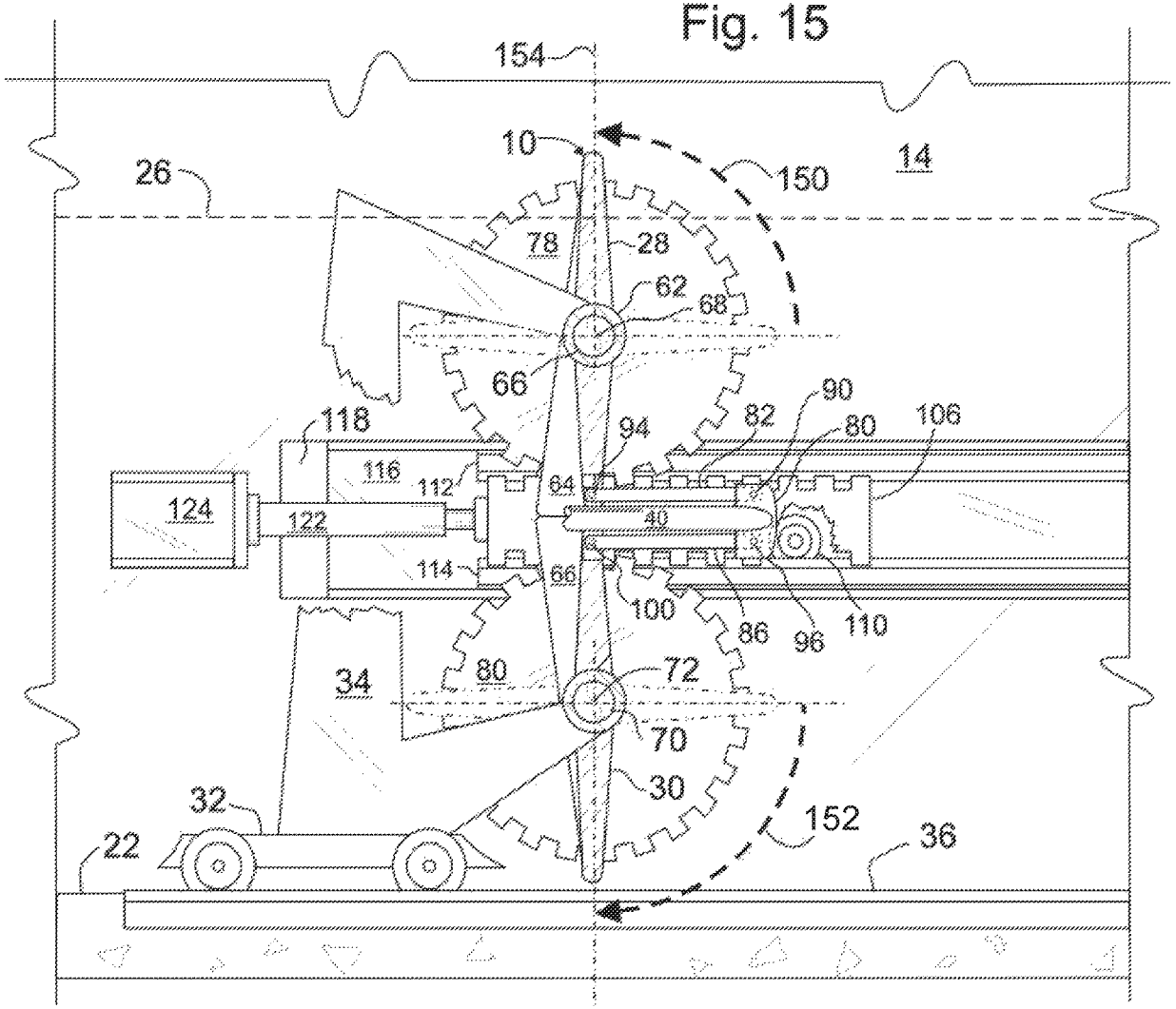
FIG. 15 shows a close-up vertical longitudinal section of an articulated plow showing an upper blade and a lower blade completely rotated to an engaged vertical attitude, ready for a subsequent wave stroke, according to some embodiments.

FIG. 15 shows a close-up of a generally vertical longitudinal section of the articulated plow 10 showing the upper blade 28 and the lower blade 30 completely rotated to the engaged vertical attitude, ready for the subsequent wave stroke 120. When the full retraction position 48 is achieved, an upper blade stop 64 and a lower blade stop 66 converge. Convergence of the upper blade stop 64 and the lower blade stop 66 prevent the upper blade 28 and lower blade 30 from traveling beyond a vertical axis 154. When the upper blade stop 64 and the lower blade stop 66 converge a limit switch (not shown) is activated to discontinue power to the piston 38, thereby completing the reciprocating cycle of the articulated plow 10 wave generator, thereby assuring proper articulation in readiness for a subsequent wave stroke 120. In some embodiments, the blades are not in a vertical position when used to provide the wave stroke 120, and instead may be positioned in any suitable orientation, including, where multiple blades are used, the same or varying orientations with respect to each other, or combinations of these.

Disclosed embodiments may remedy deficiencies of prior wave generation systems. For example, the articulated plow may provide a smooth transitional displacement of the plow during the reset stroke, without creating rip tides or turbulence, thereby creating a substantially broader range in dwell time between subsequent waves. Having this capability may give greater range in water wave energy which in turn gives greater range in the characteristics in the wave when approaching the incline and optional reef and optional subsequent beach prior toward the wave decay where water run up occurs. In another example, the mechanical engagement of a piston to the articulated plow and the mechanical engagement of the rack with the gears may prevent dynamic forces from disrupting the vertical attitude of the articulated plow in the wave energy stroke and the reset stroke. Embodiments need not rely on resistance of hydrostatic force to shift the attitude of a blade from horizontal to vertical during the reset stroke; conversely, embodiments are not caused to be undesirably acted upon by hydrostatic forces.

Embodiments may provide pure, non-turbulent true water wave energy that is directed down-stream where an inclined floor and optional reef are encountered by the wave energy. Embodiments may generate water wave energy by a simple proven device. The water wave energy created varies by the displacement and rate of displacement of the articulated plow, which in turn delivers wave energy toward the inclined floor and optional reef affecting the desired wave characteristics, causing the wave to form a crest, trough, peel and direction of peel with subsequent vortex. Embodiments may set the stage down-flow for creating a true barrel wave riding experience whereby the wave peel, direction of peel, wave amplitude, wavelength, wave frequency and wave period may be completely controlled to meet desired characteristics for board surfing.

Embodiments may be used in conjunction with computerized systems to achieve optimum desired results in establishing an infinite number of settings for water wave energy directed towards an incline and optional beach provide variable displacement and rate of displacement. Full-scale testing of the water wave energy generator may be used to refine algorithms and variables. Embodiments may generate water wave energy to provide a range of wave frequency, amplitude, wavelength, and period without having to follow specific sequences in wave characteristics. As such, disclosed embodiments may provide for the selecting of wave energy characteristics which will meet the demands of, for example, surfers competing in events or simply enjoying the challenges in the development of their skills.

Embodiments may establish the amplitude and wavelength with characteristics of the wave to be established down flow along the inclined floor and optional reef and optional beach. Furthermore, embodiments may provide for greater variation in water wave energy to establish predetermined wave amplitude and wavelength, thereby providing a prerequisite for the wave characteristics down-flow to be established by the slope of the pool floor and optional reef.

In some embodiments, the plow need not travel in constant motion, as it reciprocates to a maximum distance within the horizontal plane at the wave energy generating end of the pool, allowing the water wave energy to propagate along the inclined floor of the pool. As such, the plow need not follow the wave energy behind a board surfer thereby providing a much safer environment of the surfer.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be interpreted consistent with the principles and features as previously described.

I claim:

1. A water wave energy generation system comprising:

an articulated plow having at least one first blade that is movable within a first blade range between a first blade vertical attitude and a first blade horizontal attitude; wherein the first blade vertical attitude is more vertically aligned, with respect to a bottom surface of a pool, than the first blade horizontal attitude; and a mechanism configured for blade movement to a first blade vertical attitude of said at least one first blade in a water wave energy stroke and to a horizontal attitude of said at least one first blade in a reset stroke, wherein the mechanism comprises a piston configured to:

push the articulated plow in a down flow displacement direction in the water wave energy stroke; and pull the articulated plow in an up flow displacement direction in the reset stroke.

2. The system of claim 1, further comprising:

at least one second blade positioned vertically under said at least one first blade, said at least one second blade being movable within a second blade range between a second blade vertical attitude and a second horizontal attitude, wherein the second blade vertical attitude is more vertically aligned, with respect to a bottom surface of a pool, than the second blade horizontal attitude; and a mechanism configured for second blade movement to a down flow displacement direction of said at least one second blade in a water wave energy stroke and to an up flow displacement direction of said at least one second blade in a reset stroke.

3. The system of claim 2, further comprising a water replenishment pipe configured to maintain a static water plane within a volume of water behind the articulated plow during the water wave energy stroke.

4. The system of claim 3, wherein:

the at least one first blade has a first blade centroid axis about which the first blade rotates during the reset stroke to move the first blade from the first blade vertical attitude to the first blade horizontal attitude; and the at least one second blade has a second blade centroid axis about which the second blade rotates during the reset stroke to move the second blade from the second blade vertical attitude to the second blade horizontal attitude.

5. The system of claim 1, further comprising:

a stanchion communicating with the mechanism;

an upper control arm linking the stanchion to the first blade; and a lower control arm linking the stanchion to a second blade.

6. The system of claim 1, further comprising:

a first gear located at an end of the first blade and configured to move the first blade within the first blade range; and a second gear located at an end of the second blade and configured to move the second blade within the second blade range.

7. The system of claim 6 further comprising a rack engaged with the first gear and the second gear, the rack configured to provide rotational alignment of the first blade and the second blade.

8. The system of claim 7, wherein the rack is movable, and the system further comprises a shock absorber configured to, during the reset stroke, halt a reset stroke motion of the rack, wherein the mechanism continues to move the plow causing the first gear and the second gear to move the first gear and the second gear, respectively.

9. The system of claim 1, wherein the pool comprises a generally horizontal floor converging with an inclined floor; and an optional reef.

10. The system of claim 1, further comprising an intermediate wall separating the articulated plow from a second articulated plow.

11. An articulated plow for water wave energy generation comprising:

an upper blade movable within an upper blade range including an upper blade vertical attitude and an upper blade horizontal attitude;

a lower blade movable within a lower blade range including a lower blade vertical attitude and a lower blade horizontal attitude;

an upper blade stop coupled with the upper blade, the upper blade stop configured to restrain movement of the upper blade within the upper blade range;

a lower blade stop coupled with the lower blade, the lower blade stop configured to restrain movement of the lower blade within the lower blade range;

a stanchion;

an upper control arm linking the stanchion to the upper blade; and a lower control arm linking the stanchion to the lower blade;

wherein the articulated plow is configured to be moved in a down flow displacement direction in a water wave energy stroke; and wherein the articulated plow is configured to be moved in an up flow displacement direction in a reset stroke.

12. The articulated plow of claim 11, wherein:

the upper blade has an upper blade centroid axis about which the upper blade rotates during the reset stroke to move the upper blade from the upper blade vertical attitude to the upper blade horizontal attitude; and the lower blade has a lower blade centroid axis about which the lower blade rotates during the reset stroke to move the lower blade from the lower blade vertical attitude to the lower blade horizontal attitude.

13. A water wave energy generation system comprising:

an articulated plow having a first blade that is movable within a first blade range between a first blade vertical attitude and a first blade horizontal attitude, wherein the first blade vertical attitude is more vertically aligned, with respect to a bottom surface of a pool, than the first blade horizontal attitude;

a first mechanism configured for a first blade movement to a first blade vertical attitude of said first blade in a water wave energy stroke and to a horizontal attitude of said first blade in a reset stroke;

a second blade positioned vertically under said first blade, said second blade being movable within a second blade range between a second blade vertical attitude and a second horizontal attitude, wherein the second blade vertical attitude is more vertically aligned, with respect to the bottom surface of the pool, than the second blade horizontal attitude;

a second mechanism configured for a second blade movement to a down flow displacement direction of said second blade in a water wave energy stroke and to an up flow displacement direction of said second blade in a reset stroke;

a first gear located at an end of the first blade and configured to move the first blade within the first blade range;

a second gear located at an end of the second blade and configured to move the second blade within the second blade range; and a rack engaged with the first gear and the second gear, the rack configured to provide rotational alignment of the first blade and the second blade.

14. The system of claim 13, further comprising a water replenishment pipe configured to maintain a static water plane within a volume of water behind the articulated plow during the water wave energy stroke.

15. The system of claim 13, wherein:

the at least one first blade has a first blade centroid axis about which the first blade rotates during the reset stroke to move the first blade from the first blade vertical attitude to the first blade horizontal attitude; and the second blade has a second blade centroid axis about which the second blade rotates during the reset stroke to move the second blade from the second blade vertical attitude to the second blade horizontal attitude.

16. The system of claim 15, wherein the first blade pivots about the first blade centroid axis as the second blade simultaneously pivots about the second blade centroid axis in contrary rotational motion.

17. The system of claim 13, further comprising:

a stanchion communicating with the first mechanism and the second mechanism;

an upper control arm linking the stanchion to the first blade; and a lower control arm linking the stanchion to the second blade.

18. The system of claim 13, wherein the rack is movable, and the system further comprises a shock absorber configured to, during the reset stroke, halt a reset stroke motion of the rack, wherein the first mechanism and the second mechanism continue to move the plow in the reset stroke causing the first gear and the second gear to move the first gear and the second gear, respectively.

19. The system of claim 13, wherein the pool comprises a generally horizontal floor converging with an inclined floor; and an optional reef.

20. The system of claim 13, further comprising an intermediate wall separating the articulated plow from a second articulated plow.

21. The system of claim 13, wherein the first mechanism and the second mechanism each comprises a piston configured to:

push the articulated plow in the down flow displacement direction in the water wave energy stroke; and pull the articulated plow in the up flow displacement direction in the reset stroke.

22. The system of claim 13, wherein the rack is configured to provide rotational alignment of the first blade and the second blade such that the first blade and the second blade perform as a single blade.

* * * * *